US011236534B2

(12) United States Patent
Boesel et al.

(10) Patent No.: US 11,236,534 B2
(45) Date of Patent: Feb. 1, 2022

(54) DEADBOLT LOCK DEVICE AND ASSEMBLY

(71) Applicants: Lucas Boesel, Muskego, WI (US); Daniel Bonness, Milwaukee, WI (US); Aleksandar Markovic, Hales Corners, WI (US)

(72) Inventors: Lucas Boesel, Muskego, WI (US); Daniel Bonness, Milwaukee, WI (US); Aleksandar Markovic, Hales Corners, WI (US)

( * ) Notice: Subject to any disclaimer, the term of this patent is extended or adjusted under 35 U.S.C. 154(b) by 750 days.

(21) Appl. No.: 16/113,483

(22) Filed: Aug. 27, 2018

(65) Prior Publication Data

US 2019/0085603 A1 Mar. 21, 2019

Related U.S. Application Data

(60) Provisional application No. 62/550,258, filed on Aug. 25, 2017.

(51) Int. Cl.

| | |
|---|---|
| ***E05C 1/02*** | (2006.01) |
| ***E05B 47/02*** | (2006.01) |
| ***E05B 83/02*** | (2014.01) |
| ***E05B 15/00*** | (2006.01) |
| ***E05B 53/00*** | (2006.01) |
| ***E05B 47/00*** | (2006.01) |

(52) U.S. Cl.

CPC ..... *E05C 1/02* (2013.01); *E05B 15/0086* (2013.01); *E05B 47/0004* (2013.01); *E05B 47/026* (2013.01); *E05B 53/00* (2013.01); *E05B 83/02* (2013.01)

(58) Field of Classification Search

CPC ... E05C 1/02; E05C 1/00; E05C 1/004; E05C 1/006; E05C 1/04; E05C 1/10; E05B 15/0086; E05B 47/0004; E05B 47/026; E05B 53/00; E05B 83/02; E05B 63/0017; Y10S 292/68; Y10S 292/61; Y10S 292/36

USPC ... 292/26, 36, 137, 138, 144, 140, 143, 139, 292/145

See application file for complete search history.

(56) References Cited

U.S. PATENT DOCUMENTS 1,060,317 A * 4/1913 Bywater ..... E05B 59/00 292/40

5,911,763 A * 6/1999 Quesada ..... E05C 9/043 70/120

* cited by examiner

*Primary Examiner* — Kristina R Fulton

*Assistant Examiner* — Yahya Sidky

(74) *Attorney, Agent, or Firm* — Joseph S. Heino; Erin E. Kaprelian

(57) ABSTRACT

An assembly includes a frame and a linear actuator coupled thereto. A link, lever, spring (LLS) subassembly may be coupled to the frame and may include a short link, a long link, a lever, and a spring. A lockbolt subassembly may further be coupled to the frame. The lockbolt subassembly may comprise a latch, a bolt housing, and a lockbolt.

3 Claims, 6 Drawing Sheets

DEADBOLT LOCK DEVICE AND ASSEMBLY

This Application claims the benefit of U.S. Provisional Application No. 62/550,258, filed Aug. 25, 2017.

FIELD OF THE INVENTION

The present invention relates generally to locks and to other security devices that use locks and locking mechanisms. More specifically, it relates to a deadbolt lock device and assembly, particularly of the type that uses a linear actuator and a lockbolt that is movable along an access between unlocked and locked positions.

BACKGROUND OF THE INVENTION

Locks that utilize deadbolts are well known in the art. Such locks are also well known in the art for use with vehicles where the vehicle includes a pair of swing-away doors that enclose a cargo area of the vehicle, which is typically a cargo truck of some kind. The device and assembly of the present invention is not, however, necessarily limited to use with cargo doors only.

SUMMARY OF THE INVENTION

In the view of these inventors, there is a need for an improved deadbolt assembly that incorporates a toggle spring detent concept. The structure that incorporates such concept helps maintain a lockbolt's position while resting in the "locked" or "unlocked" position. When unlocked, the swinging doors of the cargo vehicle can open without the lockbolt sliding into the locked position. When locked, the improved design provides constant locking pressure on the latch, thereby holding the lockbolt from leaving the locked position until the actuator forces the assembly to unlock. In accordance with the present invention, the actuator does not provide the hard stops for the assembly. The actuator will not bottom out in either direction before the hard stops in the mechanism are reached, allowing of less stress on the actuator internally.

The foregoing and other features of the device and assembly of the present invention will be apparent from the detailed description that follows.

DETAILED DESCRIPTION

Figure 1:
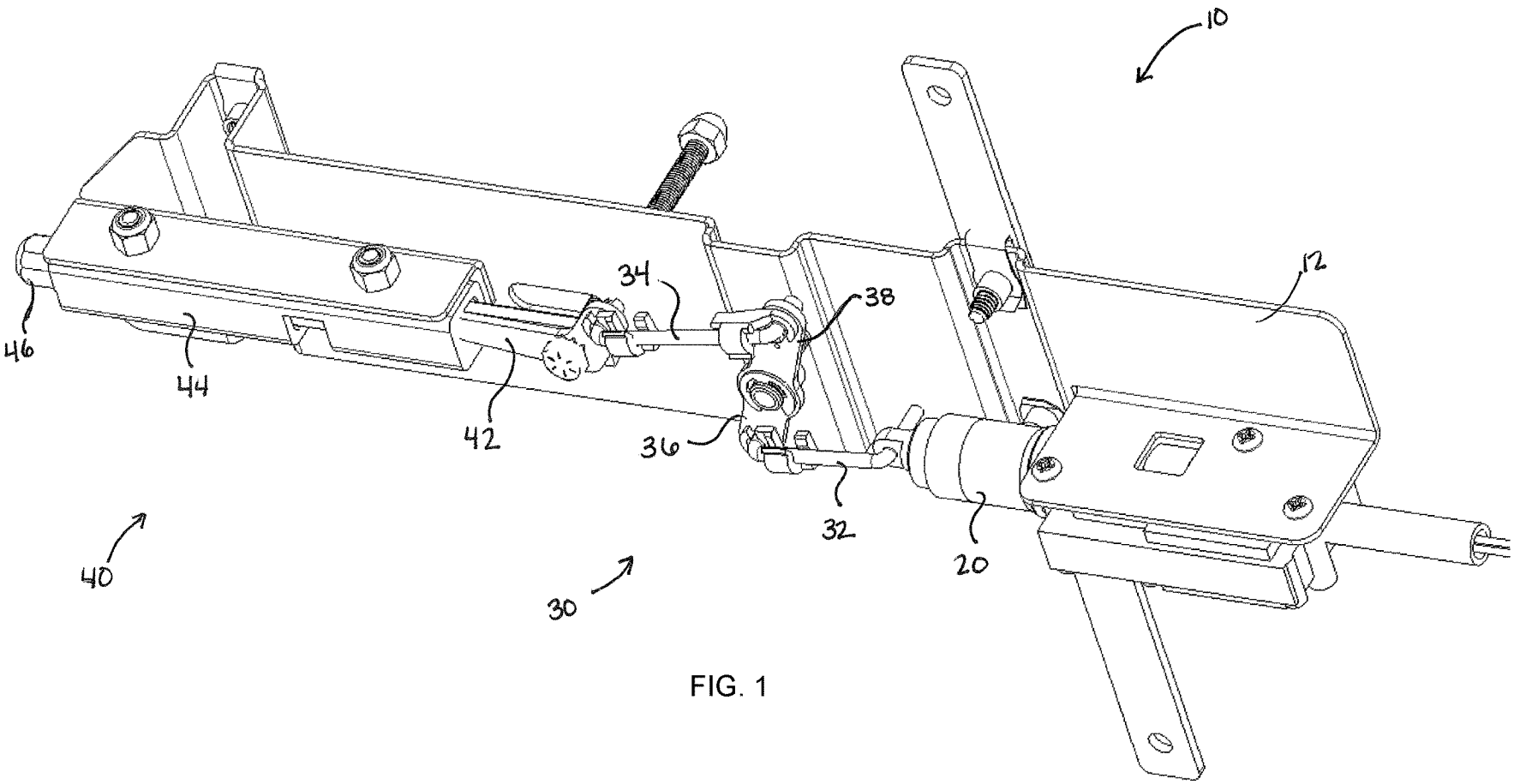
FIG. 1 is a perspective view of a deadbolt assembly consistent with the present disclosure.

Referring now to the drawings in detail, FIG. 1 is a perspective view showing a deadbolt lock device and assembly, generally identified 10, constructed in accordance with the present disclosure. As shown, the assembly 10 comprises a frame 12 that is used for mounting a number of structures used in the present invention. Those structures include a transversely-oriented linear actuator 20; a link, lever, and spring (or LLS) subassembly, generally identified 30; and a lockbolt subassembly, generally identified 40. The LLS subassembly 30 further comprises a short link 32, a long link 34, a lever 36, and a spring 38. One end of the short link 32 is secured to the actuator 20; the other end is secured to a bottom portion of the lever 36. Similarly, the long link 34 has one end secured on a top portion of the lever 36 and another end secured to the latch 42 of the lockbolt subassembly 40. The lockbolt subassembly 40 further comprises a bolt housing 44 and a lockbolt 46. The lockbolt 46 is linearly movable within the housing 44 and positioned transversely in an axial alignment that is parallel to that of the linear actuator 20.

Figure 2:
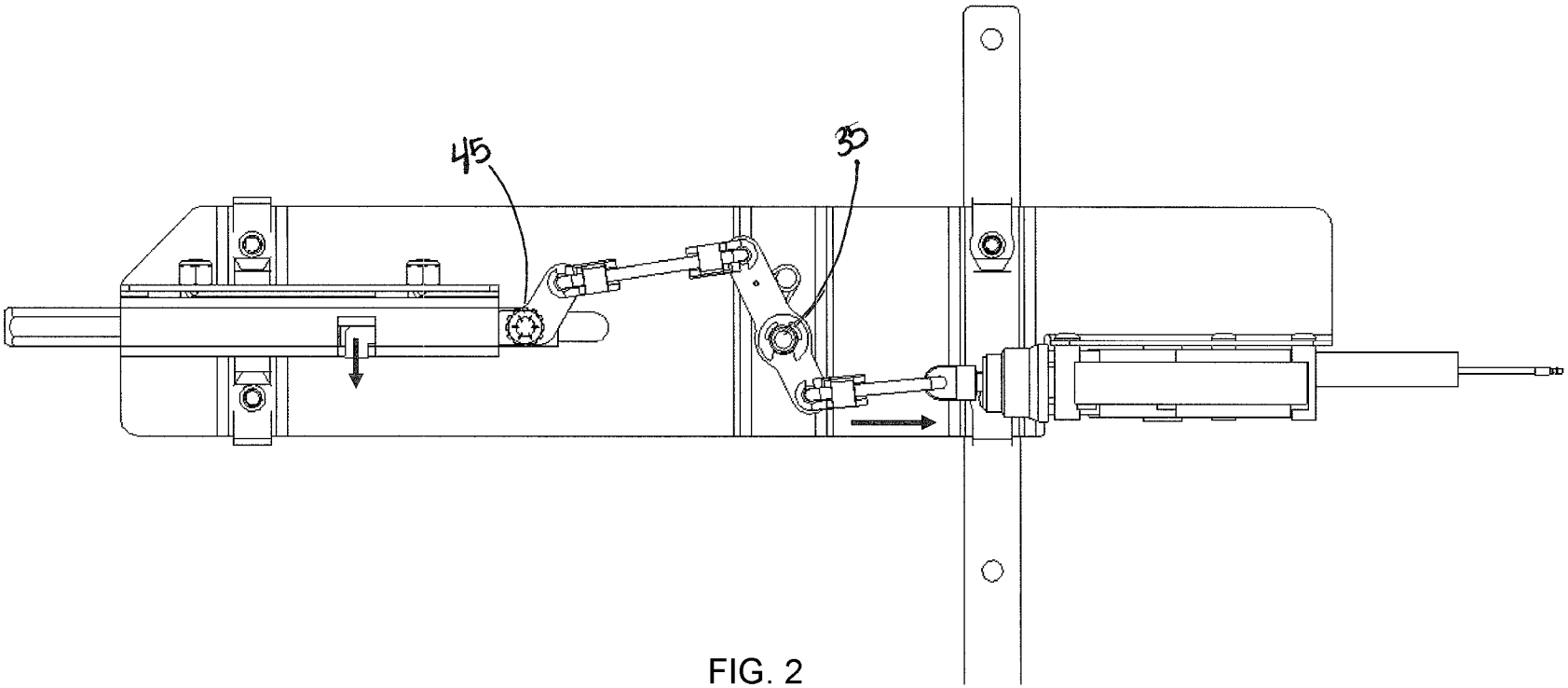
FIG. 2 is a front elevation view of the assembly and showing the forces that are imposed on components of the assembly to achieve a "locked" position of the lockbolt.

FIG. 2 shows the forces that are used to achieve a "locked" position for the assembly 10. That is, the assembly 10 is shown in the "locked" position. More specifically, FIG. 2 shows how retraction of the actuator 20 pulls the short link 32 of the LLS subassembly 30 towards the actuator 20. This results in a counterclockwise rotation of the lever 36 around a pivot point 35 of the LLS subassembly 30, thereby reversing linear motion by pushing the lockbolt 46 into a locked position. In addition, the latch 42 is rotated into its locked position. The latch 42 similarly includes a pivot point 45, about which the latch 42 is rotated in a counterclockwise direction.

Figure 3:
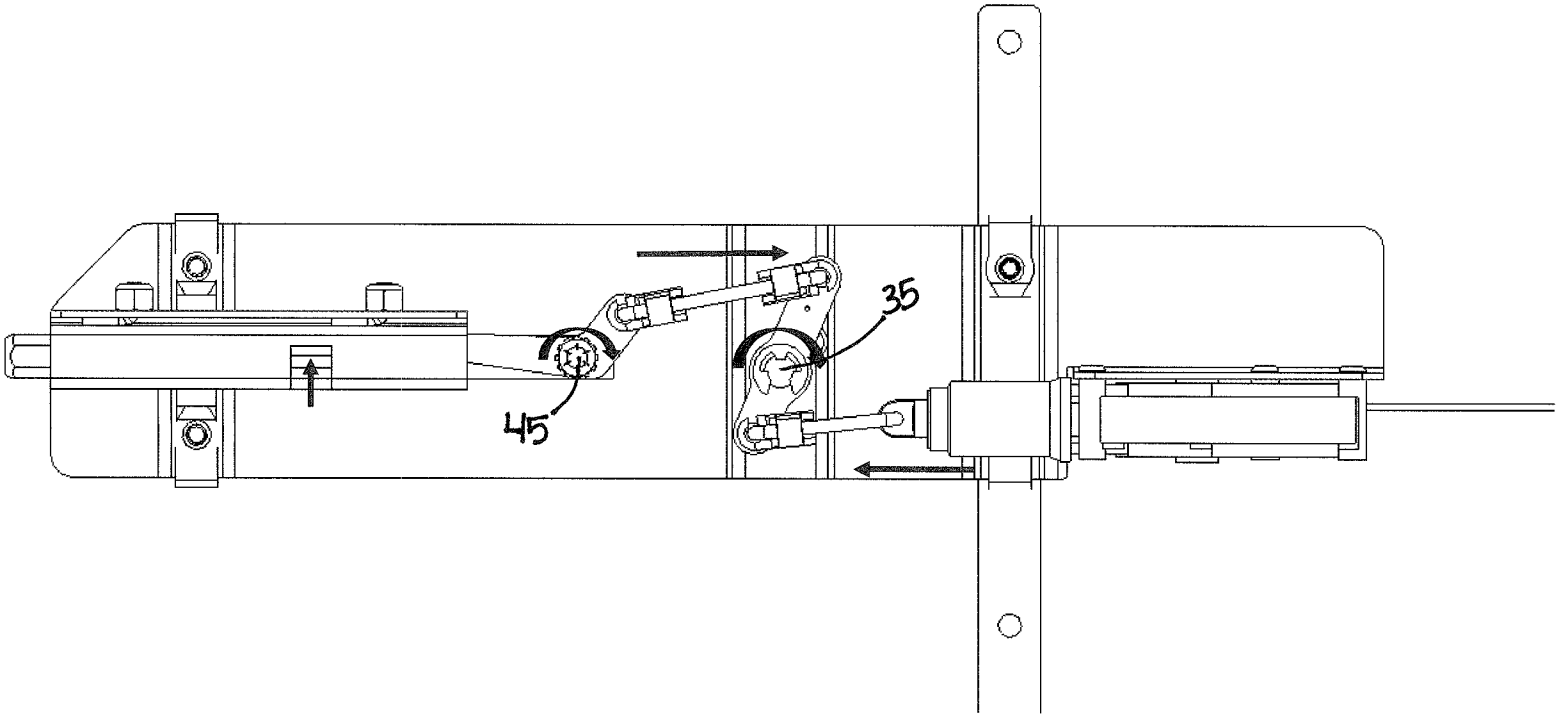
FIG. 3 is a front elevation view of the assembly and showing the forces that are imposed on components of the assembly to achieved an "unlocked" position of the lockbolt.

FIG. 3 shows the forces used to achieve an "unlocked" position. Specifically, the actuator 20 extends outwardly toward the lever 36 of the LLS subassembly 30, thereby turning the lever 36 in a clockwise direction about the pivot point 35. This results in the lever 36 pulling the long link 38 of the LLS subassembly 30 toward the actuator 20. That is, actuator 20 extends and turns the lever 36 of the LLS subassembly 30 clockwise, thus reversing linear motion and pulling the latch 42 so that it is rotated out of the lock position, while simultaneously pulling the lockbolt 46 back to the unlocked position.

Figure 4:
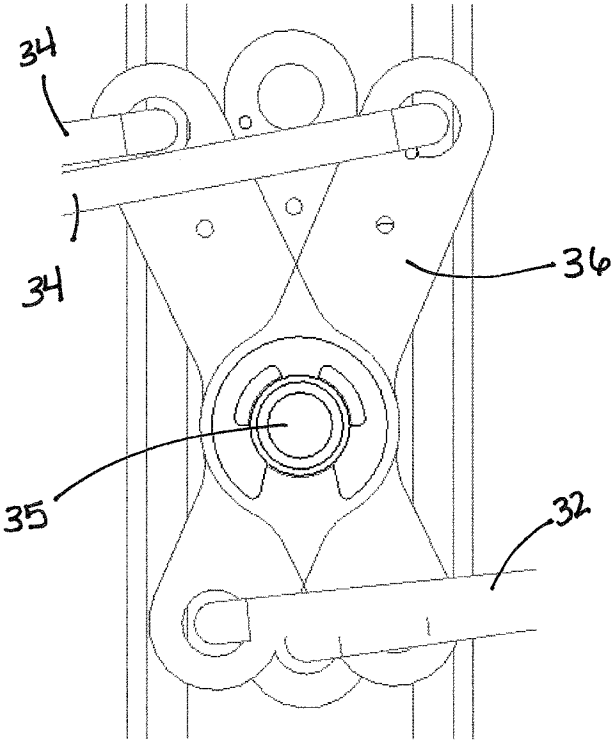
FIG. 4 is an enlarged elevation view of the lever illustrating the positional output amplification with the device and assembly consistent with the present disclosure.

FIG. 4 illustrates the mechanical output "amplification' achieved in the assembly 10 of the present invention, and the lever 36 of the LLS subassembly 30 in particular. As shown, the intended travel of the lockbolt 46 via the long link 34 of the LLS subassembly 30 is greater than that of the actuator 20 via the short link 32 of the LLS subassembly 30. This is achieved by using the lever 36 of the LLS subassembly 30 with an offset pivot point 35 to fundamentally increase output travel while allowing decreased input travel. Conversely, there is decreased input travel from the actuator 20 which is caused by external hard stops, providing less stress on the internal components of the actuator 20.

Figure 6:
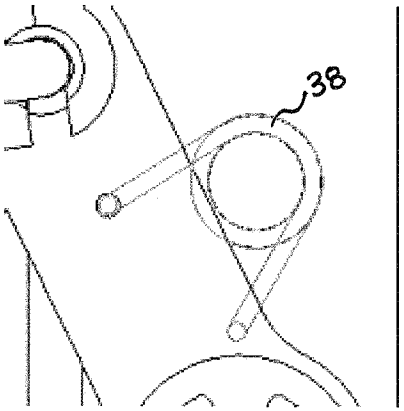
FIG. 6 is a view similar to FIG. 5 showing the force vectors acting on the lever when the assembly is in the locked position.
Figure 7:
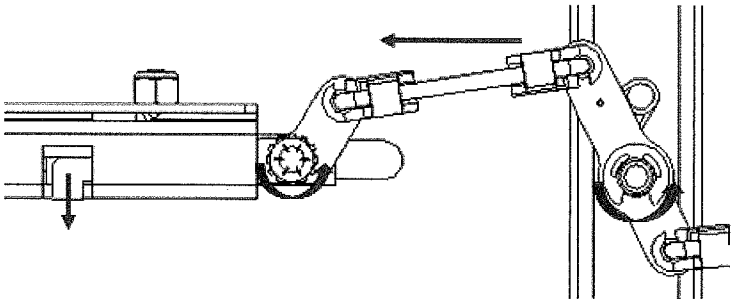
FIG. 7 is a view similar to FIG. 2 showing the relative positions of elements attached to the lever when the assembly is in the locked position.
Figure 5:
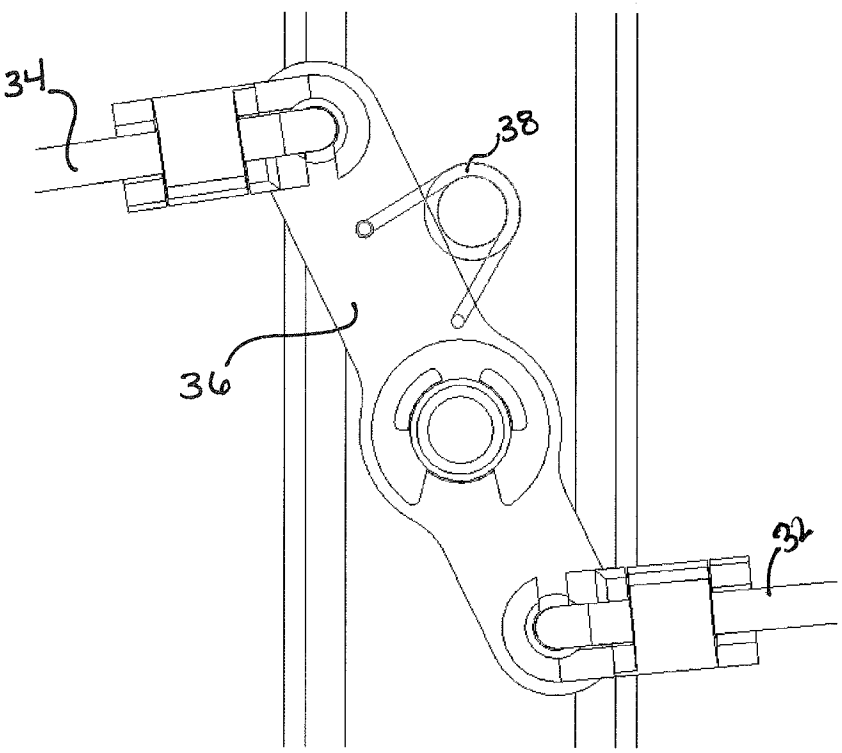
FIG. 5 is another enlarged elevation view of the lever illustrating the position of the lever spring when the assembly is in the locked position.

FIGS. 5, 6, and 7 show the spring 38 of the LLS subassembly 30 when the assembly 10 is in the "locked" position. It will be appreciated that the force vector $F_s x$ is illustrated and shown to keep constant pressure on the lock lever 36 of the LLS subassembly 30. This drives the end of the lock lever 36 of the LLS subassembly 30 into the slot and maintains the locked position after the actuator 20 has relaxed.

Figure 9:
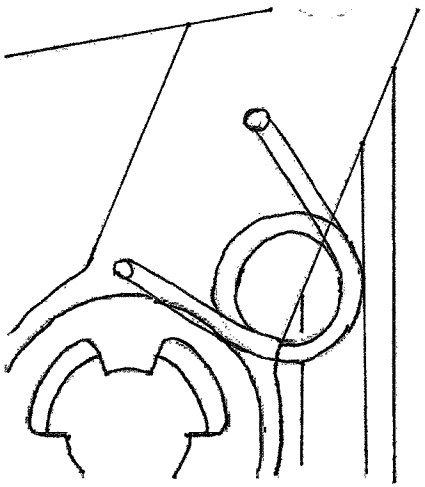
FIG. 9 is a view similar to FIG. 8 showing the force vectors acting on the lever when the assembly is in the unlocked position.
Figure 10:
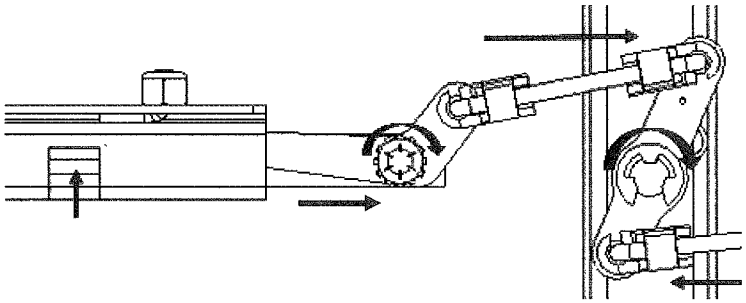
FIG. 10 is a view similar to FIG. 3 showing the relative positions of elements attached to the lever when the assembly is in the unlocked position.
Figure 8:
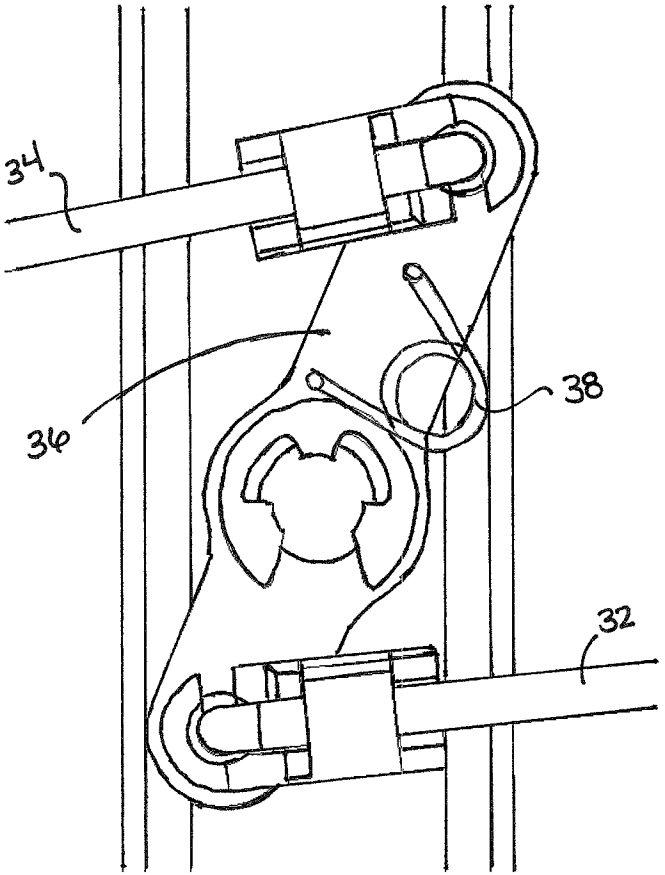
FIG. 8 is another enlarged elevation view of the lever illustrating the position of the lever spring when the assembly is in the unlocked position.

Similarly, FIGS. 8, 9, and 10 show that the force vector $F_s x$ provides a constant pressure that keeps the lockbolt 46 in its unlocked position after the actuator 20 relaxes. Additionally, external forces are prevented from moving the lockbolt 46 out of its intended unlocked position.

Additional advantages and modifications will readily occur to those skilled in the art. Therefore, the invention in its broader aspects is not limited to the specific details disclosed and described herein. Various modifications may be made without departing from the spirit and/or the scope of the general inventive concept disclosed and described herein.

The invention claimed is:

1. A locking assembly, comprising:

a linear actuator;

a lockbolt subassembly, the lockbolt subassembly further comprising:

a latch;

a bolt housing; and a lockbolt; and a link, lever, spring subassembly coupled to a frame and further comprising:

a lever;

a short link, wherein:

a first end of the short link is coupled to the linear actuator; and a second end of the short link is coupled to a bottom portion of the lever:

a long link, wherein:

a first end of the long link is coupled to the latch; and a second end of the long link is coupled to a top portion of the lever; and a spring; and wherein the linear actuator is movable between an unlocked position and a locked position; and wherein the unlocked position comprises:

extension of the linear actuator toward the lever such that the lever rotates clockwise about a pivot point and moves the long link toward the linear actuator, and rotation of the latch from the locked position; and retraction of the lockbolt.

2. The locking assembly of claim 1, wherein the locked position comprises:

retraction of the linear actuator toward the lever such that the lever rotates counterclockwise about a pivot point and moves the short link toward the linear actuator;

movement of the lockbolt into the locked position; and rotation of the latch into the locked position.

3. The locking assembly of claim 1, wherein:

the spring is coupled to the lever; and the spring maintains a constant pressure on the lever when the linear actuator is released such that the position of the lever n the locked or unlocked position is maintained.

* * * * *